US005528450A

United States Patent [19]

Willoughby et al.

[11] Patent Number: 5,528,450

[45] Date of Patent: Jun. 18, 1996

[54] ELECTRONIC BELT WITH DEACTIVATING DEVICE

[76] Inventors: Brian D. Willoughby, 7407 Berkshire Dr., Clinton, Md. 20735; Carl W. Roy, II, 9655 Ridgeview Dr., Owings, Md. 20736

[21] Appl. No.: 246,618

[22] Filed: May 20, 1994

[51] Int. Cl.[6] ..... H01H 47/00

[52] U.S. Cl. ..... 361/232; 361/179

[58] Field of Search ..... 361/230, 232, 361/187, 170, 179; 42/1.08, 1.11; 89/1.1; 109/35; 119/857, 907; 70/15–18

[56] References Cited

U.S. PATENT DOCUMENTS 3,676,738 7/1972 Scanlan ..... 361/220

4,910,634 3/1990 Pipkorn ..... 361/147

4,943,885 7/1990 Willoughby et al. ..... 361/232

5,113,308 5/1992 Takeda ..... 361/178

*Primary Examiner*—Jeffrey A. Gaffin

*Attorney, Agent, or Firm*—John Leonarz

[57] ABSTRACT

A radio receiver and its power supply are included in a circuit with a switch which is responsive to introduction of a force field, such as a magnetic field. When the field is activated, as by the introduction of a sufficiently powerful magnet, the switch is opened and the radio receiver is deactivated. Removal of the force field automatically restores the radio receiver to operable condition.

3 Claims, 1 Drawing Sheet

ELECTRONIC BELT WITH DEACTIVATING DEVICE

BACKGROUND OF THE INVENTION

Remotely controlled prisoner control belts with electronic stun units are well known and are used in various circumstances, primarily for controlling dangerous prisoners in courtrooms, transporting them to and from courtrooms, and for secure escorted travel on public conveyances. Such a device is disclosed in detail in our U.S. Pat. No. 4,943,885.

A difficulty which arises in the use of such belts occurs for example during aircraft transportation when operation of a radio receiving device may dangerously interfere with the communications necessary for navigation and operation of the aircraft, especially during take-off and landing of the aircraft. Physical removal and/or replacement of the belt, often worn under clothing, or removal of sufficient clothing to activate a key switch, may be cumbersome and inconvenient, and may compromise the safety of the public aboard the aircraft. Some stun belts have an exposed switch for deactivation, which may be operated by a key. A key switch presents a particular problem in this context since, while a prisoner may be willing to have the stun unit disabled, the prisoner may resist having it reactivated. It is therefore desirable to have a convenient means for briefly disabling the stun device, especially if the disabling means returns automatically to its enabled state, to accommodate aircraft travel.

A convenient, fast-acting disabling means provides additional advantages in the manufacture and testing of the device. Since a burst of stun power may ordinarily be delivered over six to eight seconds, a test can be cut off as soon as the test output is manifest, saving both power and wear on the stun device.

While wearable stun units can be made to be very reliable, both in activation and delivery of their charges, and in cutting off after the appointed interval, it is useful also to have an external means for externally, swiftly disabling the stun unit in case of a runaway discharge.

OBJECT OF THE INVENTION

It is therefore an object of the present invention to provide an electronic stun belt with a simple, effective means of disabling the electronic unit.

Another object is to provide a stun belt with a means for quickly cutting off the discharge of a stun unit.

Yet another object is to provide a deactivating mechanism for a prisoner control belt whose operation may be carried out without any outwardly noticeable effect, so that the prisoner and those around the prisoner may not be aware that the belt has been deactivated.

Still another object of the invention is to provide a convenient and unobtrusive means and method for disabling a wearable, prisoner control stun unit which automatically returns to the enabled state upon withdrawal of the disabling means.

BRIEF DESCRIPTION OF THE INVENTION

A circuit in the control section of the electronics of our stun belt includes a normally closed magnetic switch. When it is desired to disable the unit, a magnet of sufficient strength is placed adjacent the unit to draw the normally closed switch open, thereby disabling the unit until the magnet is removed and the switch reverts to its normally closed position.

Even when the belt is worn beneath street clothing, or even a heavy coat, the magnet chosen to work with the belt will be of sufficient strength to open the switch and achieve the disabling which is desired. As soon as the magnet is removed, the switch returns to its normal position and the guarded condition of the prisoner is restored.

Since the stun belt is normally placed to secure the stun unit electrodes on the lower portion of the prisoner's back, the guardian or another person standing adjacent the prisoner can disable the unit by unobtrusively holding a suitable magnet in the proximity of the unit. The fact of the unit's temporary disabling need not be disclosed to the prisoner.

Both during manufacture and during the period when the unit is being placed on the prisoner prior to transport, it is important to test the unit to be sure that it is working as needed. In actual operation, the unit will deliver a stun charge typically over a four to eight second interval to be sure that the prisoner is sufficiently stunned as to have abandoned an escape attempt or an attack on some person which the prisoner may have encountered during transport or a court appearance. Since the delivery of such a long charge is wearing on the stun unit, it is not desired that the full charge be delivered during each test, since a mere instantaneous operation is sufficient for test purposes. The duration of the burst is programmed into the system's electronics and it is inconvenient to vary the duration of the stun burst by modifying the code. Additionally, if the burst duration were made variable under guardian control, inevitably some guardians would neglect to restore the full burst duration after tests, leaving themselves and the bystanding public at risk from a failed stun.

Accordingly, it is appropriate to have a stun unit disabling mechanism operating externally of the system so as to leave the stun unit in its normal operational mode with a four to eight second burst to be delivered if an emergency for which the system was designed should arise. In such an emergency there may be no second chance to prevent a dangerous prisoner from causing severe harm to bystanders.

DESCRIPTION OF THE PREFERRED EMBODIMENT

Figure 1:
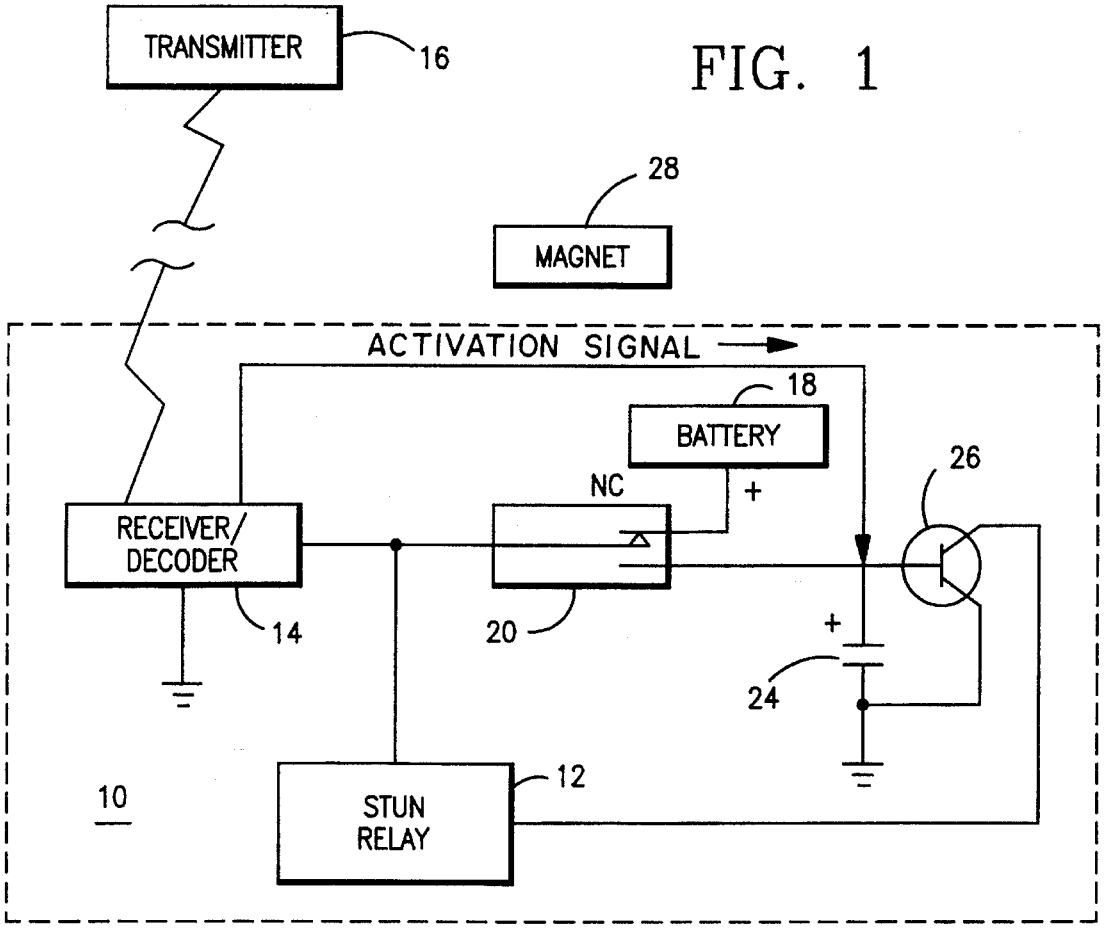
FIG. 1 is a schematic drawing of the circuit of a first embodiment of our invention.

In FIG. 1 is shown a design for a remotely activated electronic stun unit 10 which is typically mounted on a belt for controlling the activities of a dangerous prisoner during courtroom appearances, or transportation on public vehicles.

A stun relay 12, which is connected to a stun generator not shown, and which has electrodes engaged typically with the dangerous prisoner's back, is coupled in a circuit with a radio receiver/decoder unit 14 which may receive a coded signal from a remote transmitter unit 16, normally held by a guardian who can activate the stun relay by pressing buttons on the transmitter. The buttons are programmed to transmit the coded signal to the receiver which are necessary to set the stun charge process in motion.

In the electronic package on the belt, battery 18 is connected through the magnetic switch 20 which has normally closed contacts connected to maintain the receiver 14 in operation. When a properly coded signal is received by the receiver/decoder 14, an activation signal is amplified by the transistor 26 to start the stun relay 12. The magnetic switch 20 also has normally open contacts which when closed are connected to a timing capacitor 24 and through the transistor 26 to the stun relay 12.

When the field of a magnet 28 is introduced to activate a change in the positions of magnetic switch 20, the normally closed contacts open so that power to the receiver 14 is cut off. Also the normally open contacts close so that the timing capacitor 24 quickly draws its charge into the receiver 14, thus shutting down both the receiver 14 and the stun relay 12.

Figure 2:
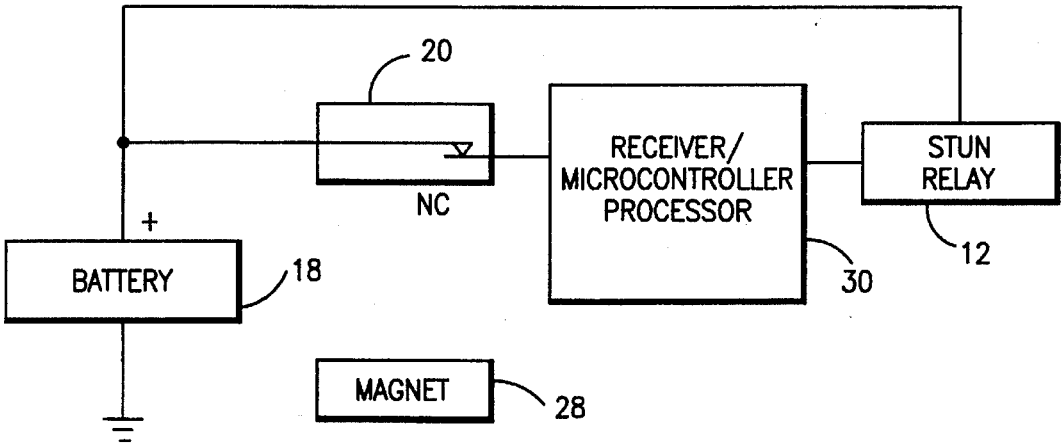
FIG. 2 is a schematic drawing of the circuit of a second embodiment of our invention.

In FIG. 2 a receiver/microcontroller/processor 30 is used in the receiving and decoding functions. A battery 18 powers the circuit through the normally closed contacts of the magnetic switch 20, through the receiver/microcontroller/processor 30 and the stun relay 12. The receiver/microcontroller/processor 30 operates by well known software which is responsive to activation of the receiver, then provides for decoding and filtering of the receiver signal to test for a valid stun activation transmission, and then activates the stun unit. In this configuration there is no need for a separate timing function to deactivate the system. Hence, an intervention by an external magnet 28 opens the normally closed contacts of the magnetic switch 20, breaking power to the electronic circuitry, thereby disabling the receiver/microcontroller/processor 30 and shutting down the stun relay 12. Removal of the magnet 28 permits the contacts of the switch 20 to close once again thereby reestablishing the operational condition of the prisoner control system.

We claim:

1. Unobtrusive disabling means for a remotely activated dangerous prisoner control device of the type having radio signal receiving apparatus responsive to radio signal activation for stunning a dangerous prisoner wearing said device, comprising:

a switch having a first position, normally closed for operation of said radio signal receiving means, and a second positions, which is open for disabling said operation of said radio signal receiving means, for control of a circuit, said circuit including said radio signal receiving means, and said switch including means responsive to a magnetic force field for changing said switch from said first position to said second position for disabling said radio signal receiving means.

2. The disabling means of claim 1 wherein said switch further includes means responsive to removal of said magnetic force field for changing said switch from said second position to said first position for enabling said radio signal receiving means.

3. Method for disabling and reactivating a radio controlled prisoner control electronic stun device having radio signal receiving means in circuit with a power source and a control switch responsive to a force field for opening and closing contacts of said switch, said switch contacts being normally closed for operation of said radio signal receiving means, comprising the steps of:

bringing a force into proximity of said stun device, said force having sufficient strength for opening said switch contacts for interrupting power to said radio signal receiving means, and removing said force for closing said contacts and restoring said power to said radio signal receiving means.

* * * * *